United States Patent [19]

Citino et al.

[11] Patent Number: 4,661,745

[45] Date of Patent: Apr. 28, 1987

[54] RAPID-START FLUORESCENT LAMP POWER REDUCER

[75] Inventors: Richard J. Citino, Revere; Carlo S. Bessone, Bedford; William J. Roche, Merrimac, all of Mass.

[73] Assignee: GTE Products Corporation, Danvers, Mass.

[21] Appl. No.: 723,403

[22] Filed: Apr. 15, 1985

Related U.S. Application Data

[63] Continuation-in-part of Ser. No. 576,795, Feb. 6, 1984, abandoned.

[51] Int. Cl.[4] ..... H05B 41/16

[52] U.S. Cl. ..... 315/106; 315/228; 315/240; 315/107; 315/DIG. 5; 315/94

[58] Field of Search ..... 315/106, 107, 101, DIG. 5, 315/88–89, 94–95, 96–99, 227–228, 240, 250, 324, 360

[56] References Cited

U.S. PATENT DOCUMENTS

| | | | |
|---|---|---|---|
| 3,866,087 | 2/1975 | Powell | 315/96 |
| 4,010,399 | 3/1977 | Bessone et al. | 315/101 |
| 4,082,981 | 4/1978 | Morton et al. | 315/97 |
| 4,146,820 | 3/1979 | Bessone et al. | 315/227 R |
| 4,256,993 | 3/1981 | Morton | 315/106 |
| 4,339,690 | 7/1982 | Regan et al. | 315/106 |
| 4,425,530 | 1/1984 | Hammer et al. | 315/97 |
| 4,475,062 | 10/1984 | Radenkovich et al. | 315/88 |
| 4,559,478 | 12/1985 | Fuller et al. | 315/106 |

*Primary Examiner*—David K. Moore
*Assistant Examiner*—M. Razavi
*Attorney, Agent, or Firm*—Thomas H. Buffton; Carlo S. Bessone

[57] ABSTRACT

A rapid-start fluorescent lamp system includes a ballast circuit, rapid-start fluorescent lamps and power reducing means for controlling the application of energy to the lamps. The power-reducing means controls the energy to N/O switches from the energy source upon ionization of the rapid-start fluorescent lamps.

7 Claims, 2 Drawing Figures

RAPID-START FLUORESCENT LAMP POWER REDUCER

This is a continuation-in-part of co-pending application Ser. No. 576,795 filed on Feb. 6, 1984, now abandoned.

TECHNICAL FIELD

This invention relates to rapid-start fluorescent lamp systems and more particularly to rapid-start fluorescent lamp systems having a power-reducing means which includes a relay having a plurality of normally-open (N/O) switches for coupling filament windings to and decoupling filament windings from, after a given period of time, the filaments of fluorescent lamps.

BACKGROUND ART

In the fluorescent lamp art, the so-called rapid-start type of fluorescent lamp system is quite common. Therein, the filaments of the lamps are preheated for a short period of time to protect them from damage which often occurs with a cold ignition type system. Thereafter, ignition of the lamps is effected and the filament preheating potentials are no longer necessary.

Recently, there has been considerable emphasis on apparatus and techniques for reducing the electrical energy consumed by fluorescent light systems. One known attempt to reduce electrical energy expenditure is set forth in U.S. Pat. No. 4,256,993 issued to Morton on Mar. 17, 1981. Therein, a normally-closed (N/C) switch is coupled to a filament of one of a pair of fluorescent lamps. The (N/C) switch is shunted by a power reducing capacitor and a power reducing circuit is employed to direct the coupling and decoupling of the lamp filament and an energizing source. In effect, energy from a source is directly applied to the filament of one of a pair of fluorescent lamps through a (N/C) switch for a time period sufficient to insure ignition of the lamps. Thereafter, the power reducing capacitor is series connected with the filament of the lamp and the filament winding or energy source. Thus, the N/C switch is energized to provide a power-reducing capacitor in series with the filament of the rapid-start fluorescent lamp after lamp ignition.

A somewhat similar result is obtained with the system set forth in U.S. Pat. No. 4,146,820 issued to Bessone et al on Mar. 27, 1979. Herein, a power reducing system includes a pair of N/O switches each shunted by a power reducing capacitor and coupled to one filament of a fluorescent lamp. A power reducing means energizes the switches to provide a direct connection to the filaments from an energizing source for a given period of time or until the lamp ionizes. Thereafter, the energy applied to the switches is removed, the switches open and a capacitor is inserted into each line intermediate the energy source and the fluorescent lamp filament.

Still another approach to the conservation of power in a rapid-start fluorescent system is set forth in U.S. Pat. No. 4,010,399 issued on Mar. 1, 1977 to Bessone et al. Therein, a triac and two voltage divider resistors form a solid state switch which is inserted in each filament circuit of a pair of fluorescent lamps. The triac provides a low resistance path for applying power to the lamp filaments until lamp ionization is effected. Thereafter, the voltage across the voltage divider of each switch cuts off the triac current flow to the filament.

Although each of the above-described techniques does provide an advantage and a reduction in energy consumption over other known apparatus, each does leave something to be desired. For example, Morton (993) employs a single N/C switch coupling one lamp filament to an energizing source and also inserts a capacitor in the circuit upon ionization of the lamp. However, the N/C switch requires a constant source of energy to maintain a desired operational condition, the inserted capacitor reduces the light available from the lamp and heater current is disconnected in but one of multiple filaments of the lamp system.

Also, Bessone et al (820) employs but a single switch to reduce the current applied to one filament upon ionization of the lamp. Unfortunately, heater current is applied to the remaining filaments which is deleterious to conservation. Moreover, the introduced power reducing capacitors cause a reduction in light output available from the lamps. Moreover, Bessone et al (399) necessitates a power loss in each filament circuit due to the incorporated resistors of the solid state switching devices. Accordingly, the above techniques are expensive of components and labor, are limited in so far as a reduction in filament heating is concerned or undesirably reduce the light output available from the lamps. Moreover, switches shunting capacitors must be of a relatively heavy-duty type in order to absorb the energy available from a fully loaded capacitor.

OBJECTS AND SUMMARY OF THE INVENTION

An object of the present invention is to provide an enhanced rapid-start fluorescent lamp system. Another object of the invention is to reduce the energy requirements of a rapid-start fluorescent lamp system. Still another object of the invention is to reduce the energy requirements without deleterious effect upon the efficiency and light output of a rapid-start fluorescent lamp system. A further object of the invention is to decouple all of the filaments of a rapid-start fluorescent lamp system from the filament windings upon ionization of the fluorescent lamps of the system.

These and other objects, advantages and capabilities are achieved in one aspect of the invention by a rapid-start fluorescent lamp system having a ballast connectable to an energizing source with a plurality of filament windings, a plurality of fluorescent lamps each having a pair of spaced filaments and a power-reducing means which includes a relay having a plurality of normally open switches and a charging circuit wherein the charging circuit controls the time period for coupling the filaments to the filament windings and for decoupling the filaments from the filament windings of the ballast.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
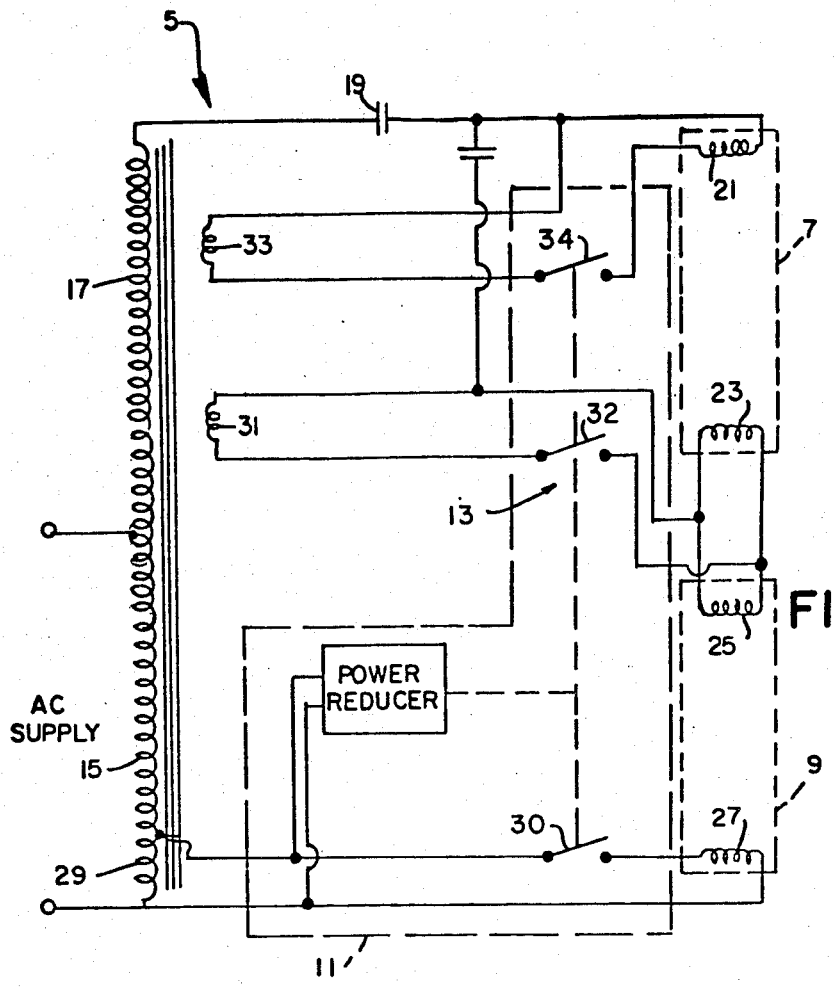
FIG. 1 is a schematic and block diagram illustrating a preferred form of a rapid-start fluorescent lamp system.

Referring to the drawings, FIG. 1 illustrates a rapid-start fluorescent lamp system of the invention. Here, a ballast circuit 5 is coupleable to an energizing source such as an AC supply and to a pair of series-connected rapid-start fluorescent lamps 7 and 9 respectively. A power reduction means 11 is shunted across a portion of the ballast circuit 5 and includes a switching means 13 for coupling and decoupling the ballast circuit 5 and the rapid-start fluorescent lamps 7 and 9.

More specifically, the ballast circuit 5 includes a primary winding 15 coupled to an energizing source such as an AC supply for example. A secondary winding 17 is coupled to a power factor correcting capacitor 19 which is, in turn coupled to a filament 21 of a plurality of filaments 21, 23, 25 and 27 of the rapid-start fluorescent lamps 7 and 9. The ballast circuit 5 also includes, in the example, three filament windings 29, 31 and 33 respectively.

The power reduction means 11 is shunted across one of the filament windings 29 and includes gauged normally-open (N/O) switches 30, 32 and 34 each connected to a respective filament winding, 29, 31, and 33 and formed for coupling to the filaments 27, 25, 23 and 21 of the rapid-start fluorescent lamps 7 and 9. Thus, energization of the system causes closure of the gauged N/O switches 30, 32, and 34 and application of power to the filaments 27, 25, and 23, and 21 for a given period of time whereupon the N/O switches 30, 32 and 34 are de-energized.

Figure 2:
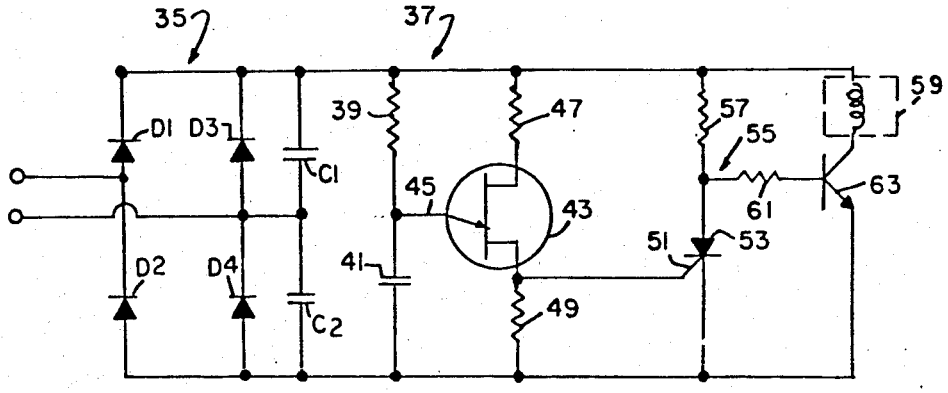
FIG. 2 is a schematic illustration of a preferred form of power reducing means suitable to the lamp system of FIG. 1.

Referring to the power reduction means 11, FIG. 2 illustrates a particular embodiment which includes a rectifier and voltage doubler circuit 35 having a plurality of diodes, $D_1$, $D_2$, $D_3$, and $D_4$ and a pair of capacitors $C_1$ and $C_2$. This rectifier and voltage doubler circuit 35 is shunted across one of the filament windings, 29 in this instance, of the ballast circuit 5. A charge or RC timing circuit 37, which includes a series-connected resistor 39 and capacitor 41, is shunted across the rectifier and voltage doubler circuit 35. Also a unijunction transistor 43 has an emitter 45 coupled to the junction of the resistor 39 and capacitor 41 and first and second base biasing resistors 47 and 49 coupled to shunt the transistor 43 across the charge circuit 37.

The output of the unijunction transistor 43 is coupled to the gate electrode 51 of silicon controlled rectifier (SCR) 53 and the SCR 53 is coupled to the junction of a pair of resistors 57 and 61 of a voltage divider circuit 55. A transistor 63 has a base coupled to the resistor 61 of the voltage divider circuit 55 and a collector coupled to a relay 59. The series-connected transistor 63 and relay 59 shunt the voltage doubler circuit 35 and the RC timing circuit 37. Moreover, the relay 59 is operationally coupled to those N/O switches 30, 32 and 34 of the switching means 13 of FIG. 1.

In operation, energy from an AC source is applied to the primary winding 15 of the ballast 5 of FIG. 1 and provides a potential, about 3.6 volts for example, across each of the filament windings 29, 31 and 33. This filament winding 29 is applied to the rectifier and voltage doubler circuit 35 of the power reduction means 11 shunted thereacross. An output potential of about 5.6 volts from the voltage doubler circuit 35 is applied to the voltage divider circuit 55. Thereupon, the transistor 63 is rendered conductive and the relay 59 is energized. In turn, the N/O switches 30, 32, and 34 are closed and heater current is applied to the filaments 21, 23, 25, and 27 of the lamps 7 and 9.

At the same time, the charge or timing circuit 37 is designed to have a time constant of about eight (8) seconds which is ordinarily sufficient time for ionization of the lamps 7 and 9 to be effected. Thereafter, the potential developed at the capacitor 41 is sufficient to trigger the unijunction transistor 43 which switches the SCR 53 into a conductive state. As a result, the potential at the base of the transistor 63 is essentially short-circuited, the relay 59 deactivated and the filaments 21, 23, 25, and 27 decoupled from the filament windings 29; 31 and 33 due to deactivation of the N/O switches 30, 32 and 34.

The following component values are appropriate to the embodiment of FIG. 2 although the components values are in no way to be construed as limiting;

| COMPONENTS | |
|---|---|
| Unijunction Transistor | 2N2646 (Motorola) |
| SCR | MCR101 (Motorola) |
| Transistor | 2N3904 (Motorola) |
| Relay | HE524A0500 (Hamlin) |
| Capacitors C1, C2 | 220 uf |
| Capacitor 41 | 10 uf 16 volt |
| Resistor 39 | 0.68 megohms |
| Resistor 47 | 150 ohms |
| Resistor 49 | 470 ohms |
| Resistor 57 | 470 ohms |
| Resistor 61 | 1000 ohms |
| Diodes $D_1$, $D_2$, $D_3$, $D_4$ | 1N4001 (Motorola) |

Thus, a rapid-start fluorescent lamp power-reducing system has been provided wherein N/O switches which do not require applied power except for a very limited time period serve to disconnect not one but all of the filaments of a pair of fluorescent lamps upon attainment of ionization by the lamps. In this manner power consumption by as much as 7.5% is achieved in a 40-watt lamp system. Moreover this reduction in power is effected without an accompanying reduction in available light from the lamps.

While there have been shown what are at present considered to be preferred embodiments of the invention, it will be apparent to those skilled in the art that various changes and modifications can be made herein without departing from the scope of the invention as defined by the appended claims.

INDUSTRIAL APPLICABILITY

An enhanced rapid-start fluorescent lamp system is provided which includes normally-open (N/O) switches for each filament winding of a ballast. Also, a power reduction means controls energy application to the switches for a period long enough to insure ionization of the lamps. Thereafter, energy to the switches and to the lamp filaments is discontinued. Accordingly, power consumption is reduced without a reduction in light output.

We claim:

1. A rapid-start fluorescent lamp power-reducing system comprising:

a plurality of rapid-start fluorescent lamps each having a pair of spaced filaments;

a ballast formed for connection to an energizing source and including a plurality of filament windings for energizing said filaments of said lamps; and a power-reducing means shunting one of said filament windings and including a relay having a plurality of N/O switches each coupled to a respective one of said filament windings, said power-reducing means responsive to energization from said source for operating said relay closing said N/O switches and connecting said filament windings to aid filaments of said lamps for a given period of time sufficient to effect ionization of said lamps and de-energizing said relay, opening said N/O switches and disconnecting said filament windings from said filaments of said lamps after said given period of time required to effect ionization of said lamps.

2. The power-reducing system of claim 1 said plurality of rapid-start fluorescent lamps includes a pair of lamps each having a pair of spaced filaments.

3. The power-reducing system of claim 2 wherein said power-reducing means includes a relay having a N/O switch coupling a filament of each of said pair of lamps to a filament winding of said ballast and a N/O switch coupling a filament of both of said pair of lamps to a filament winding of said ballast.

4. The power-reducing system of claim 2 wherein said power-reducing means including a charging circuit for controlling the time period said filaments are connected to and disconnected from said filaments windings of said ballast.

5. A power-reducing system for rapid-start fluorescent lamps comprising:

a pair of fluorescent lamps each having a pair of spaced filaments;

a ballast connectable to an energizing source and having a plurality of filament windings; and a power-reducing means shunting one of said plurality of filament windings and including a relay having a plurality of normally-open (N/O) switch contacts each coupled to a respective one of said plurality of filament windings of said ballast, said relay formed for activating said N/O switches contacts to couple said filament windings to said lamp filaments for a period of time sufficient to effect ionization of said lamps and for decoupling said filament windings from said filaments upon ionization of said lamps.

6. The power-reducing system of claim 5 wherein said ballast includes a first and third filament winding each connectable by a N/O switch to a filament of one of said pair of fluorescent lamps and a second filament winding connectable by a N/O switch to a pair of parallel connected filaments of both of said pair of fluorescent lamps.

7. The power-reducing system of claim 5 wherein said power-reducing means includes a charging circuit for controlling said time period of said coupling and decoupling of said filament windings and filaments.

* * * * *